US006037913A

United States Patent [19]

Johnson

[11] Patent Number: 6,037,913

[45] Date of Patent: Mar. 14, 2000

[54] MOVEABLE SATELLITE DISH ANTENNA MOUNT

[76] Inventor: Pamela Kay Johnson, 1219 N. Burke St., Kokomo, Ind. 46901-1901

[21] Appl. No.: 09/311,625

[22] Filed: May 13, 1999

[51] Int. Cl.[7] ..... H01Q 3/02

[52] U.S. Cl. ..... 343/882; 343/883; 343/890; 248/278

[58] Field of Search ..... 343/878, 879, 343/882, 883, 890, 901, 755, 756; 248/183, 278

[56] References Cited

U.S. PATENT DOCUMENTS

| | | | |
|---|---|---|---|
| 3,910,538 | 10/1975 | Baitella | 248/122 |
| 3,977,645 | 8/1976 | Deely | 248/484 |
| 4,126,865 | 11/1978 | Longhurst et al. | 343/766 |
| 4,402,481 | 9/1983 | Sasaki | 248/276 |
| 4,431,329 | 2/1984 | Baitella | 403/55 |
| 4,453,695 | 6/1984 | Sennott et al. | 248/660 |
| 4,491,435 | 1/1985 | Meier | 403/55 |
| 4,531,855 | 7/1985 | Wallis | 403/55 |
| 4,617,572 | 10/1986 | Hugo | 343/765 |
| 4,748,451 | 5/1988 | Edwards | 343/880 |
| 4,767,231 | 8/1988 | Wallis | 403/56 |
| 4,814,781 | 3/1989 | DeHaven | 343/766 |
| 4,868,578 | 9/1989 | Bruinsma et al. | 343/882 |
| 4,932,620 | 6/1990 | Foy | 248/124 |
| 4,994,816 | 2/1991 | Kondo | 343/762 |
| 4,998,114 | 3/1991 | Eto et al. | 343/840 |
| 5,198,830 | 3/1993 | Lin | 343/882 |
| 5,284,313 | 2/1994 | Hallgren | 248/279 |
| 5,337,062 | 8/1994 | Sherwood et al. | 343/711 |
| 5,419,521 | 5/1995 | Matthews | 248/278 |
| 5,473,335 | 12/1995 | Tines | 343/766 |
| 5,479,181 | 12/1995 | Simpson | 343/882 |
| 5,528,250 | 6/1996 | Sherwood et al. | 343/711 |
| 5,604,508 | 2/1997 | Atkinson | 343/879 |
| 5,609,565 | 3/1997 | Nakamura | 600/229 |
| 5,641,191 | 6/1997 | Jia | 276/97.6 |
| 5,646,638 | 7/1997 | Winegard et al. | 343/882 |
| 5,779,209 | 7/1998 | Rello | 248/278.1 |
| 5,813,286 | 9/1998 | Hansen | 74/490.02 |
| 5,933,123 | 8/1999 | Kaul | 343/879 |

FOREIGN PATENT DOCUMENTS

| | | | |
|---|---|---|---|
| 1122256 | of 1956 | France | 248/279 |
| 60-187104 | 9/1985 | Japan . | |

OTHER PUBLICATIONS

Brochure, Kaul–Tronics, Inc., "Delivering the Future, DBS Antennas & Accessories", undated.

*Primary Examiner*—Don Wong
*Assistant Examiner*—Tan Ho
*Attorney, Agent, or Firm*—Robert T. Canavan

[57] ABSTRACT

A mounting for a satellite dish antenna may be used in multi-unit or other dwellings in which mounting to exterior surfaces is forbidden. The mount includes a base mountable to a wall or to a balcony railing, an extension arm that pivots about the base and telescopes in length, and an aiming system attached to the end of the extension arm for mounting the antenna. In use, the mounting is attached to a wall or railing, the arm is rotated and telescoped outward, and the aiming system is used to aim the antenna at a satellite. The aiming system and the rotation and extension of the extension arm may be done remotely for convenience and to permit operation by disabled persons.

22 Claims, 5 Drawing Sheets

MOVEABLE SATELLITE DISH ANTENNA MOUNT

FIELD OF THE INVENTION

This invention relates to a moveable satellite dish antenna mount that can be used by residents of multi-unit housing, and can be remotely operated. The invention further relates to a method for positioning a satellite dish antenna outside a multi-unit dwelling for reception of broadcast satellite programming.

BACKGROUND OF THE INVENTION

Condominiums, apartment complexes and other multi-unit dwellings often have regulations forbidding the attachment of antennas or satellite dishes to the roof or outside walls of the building. Because a satellite dish requires line-of-sight reception, such regulations may effectively prevent a condominium or apartment dweller from owning such a device. While many multi-unit dwellings have balconies providing access to the outdoors, the exposure of the balcony is not necessarily in the direction needed to receive a broadcast from a satellite. A portable floor platform for mounting the antenna is therefore not sufficient in most cases.

Satellite antennas must be cleaned and maintained occasionally in order to keep them in optimum working condition. The antennas must also be aimed with reasonable precision at the target satellite. Cleaning and maintaining often involves movement of the antenna for access and as a result of the cleaning or maintaining operations themselves. A satellite dish antenna may also be moved in order to protect the dish from severe weather. It is therefore important that a satellite dish antenna may be conveniently retracted and returned to the same position and re-aimed with relative ease.

Further, the elderly and disabled must be capable of retracting, extending and re-aiming the satellite dish.

Accordingly, there is a need to provide a satellite dish antenna mount that may be used in multi-unit dwellings without attachment to an exterior surface of the building, and that may be retracted, extended and re-aimed conveniently in order to permit cleaning, maintenance and protection from the weather.

SUMMARY OF THE INVENTION

An object of the present invention is to fulfill the needs referred to above. In accordance with the principles of the present invention, this objective is obtained by providing a mount for attaching a satellite dish to a building, extending the satellite dish toward and away from the building and aligning the satellite dish to a broadcast satellite. The mount includes a base for attaching the mount to the building, and an elongate extension member having first and second telescoping elements. The first telescoping element is pivotably attached to the base for rotation about an extension axis, while the second telescoping element is slideably mounted to the first telescoping element for relative linear movement. The mount also includes a dish aiming system mounted to the end of the second telescoping element. The aiming system includes at least one aiming pivot for rotation about an aiming axis. Attached to said dish aiming system for rotation with the pivot is a satellite dish mount for mounting the satellite dish. The satellite dish is displaced toward and away from the building by pivoting the extension member about the extension axis and by sliding the second telescoping member relative to said first telescoping member. The dish is aligned to the broadcast satellite by rotating the satellite dish mount about the aiming pivot.

The base for attaching the mount to a building comprises a plate having mounting holes, or may be constructed and arranged for mounting to a balcony railing. The first and second telescoping elements may have rectangular cross-sections, or cross-sections may be round.

The extension member may include a motor drive for sliding the second telescoping member relative to the first telescoping member.

Alternatively, a handcrank-operated drive may be used. The mount may include a pivot lock to lock the extension member to the base to prevent pivoting. The pivot lock may include opposing clamping members biased against each other, and may also include means for locking the extension member to the base in a predetermined position. The means for locking in a predetermined position may be a locking pin fixed to the extension member and a locking pin hole in the base, or vise versa.

A motor drive may be used for pivoting the extension member with respect to said base. The extension member may be extendible to a length of between about four and seven feet.

The dish aiming system may include two aiming pivots and motor drives for rotating the aiming pivot. The motor drives may be remotely operable from inside the building. One remotely operable configuration includes a wireless receiver attached to the mount, and a remote control for communication with the wireless receiver from inside the building.

In accordance with another aspect of the invention, a mount is provided for attaching a satellite dish to a building, extending the satellite dish toward and away from the building and aligning the satellite dish to a broadcast satellite. The mount includes a base for attaching the mount to the building, an elongate extension member pivotably attached to the base at a proximal end of the extension member for rotation about an extension axis, a pivot lock constructed and arranged to lock the extension member to the base in a predetermined position to prevent pivoting, a dish aiming system mounted to a distal end of the extension member, and a satellite dish mount attached to the dish aiming system for mounting the satellite dish. The pivot lock may include a locking pin fixed to one of the extension member and the base and a locking pin hole in the other of the extension member and the base.

Yet another aspect of the invention is a method of placing a satellite dish for reception of broadcast satellite programming. The method includes the step of providing a satellite dish mount having a base, a telescoping extension arm pivotably attached to the base, and a dish aiming system attached to the extension arm for mounting the satellite dish antenna. The base is mounted to a non-exterior surface of a building, and the dish antenna is mounted on the dish aiming system. The extension arm is rotated with respect to the base and the extension arm is extended so the satellite dish antenna has line-of-sight access to a broadcast satellite. The satellite dish antenna is aimed at the satellite using the dish aiming system. The dish aiming system may be remotely operable and the step of aiming the satellite dish antenna may be done remotely. Furthermore, the extension arm may be remotely rotatable and extendible, and the step of extending and rotating the extension arm may be done remotely.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE PREFERRED EMBODIMENTS

Figure 1:
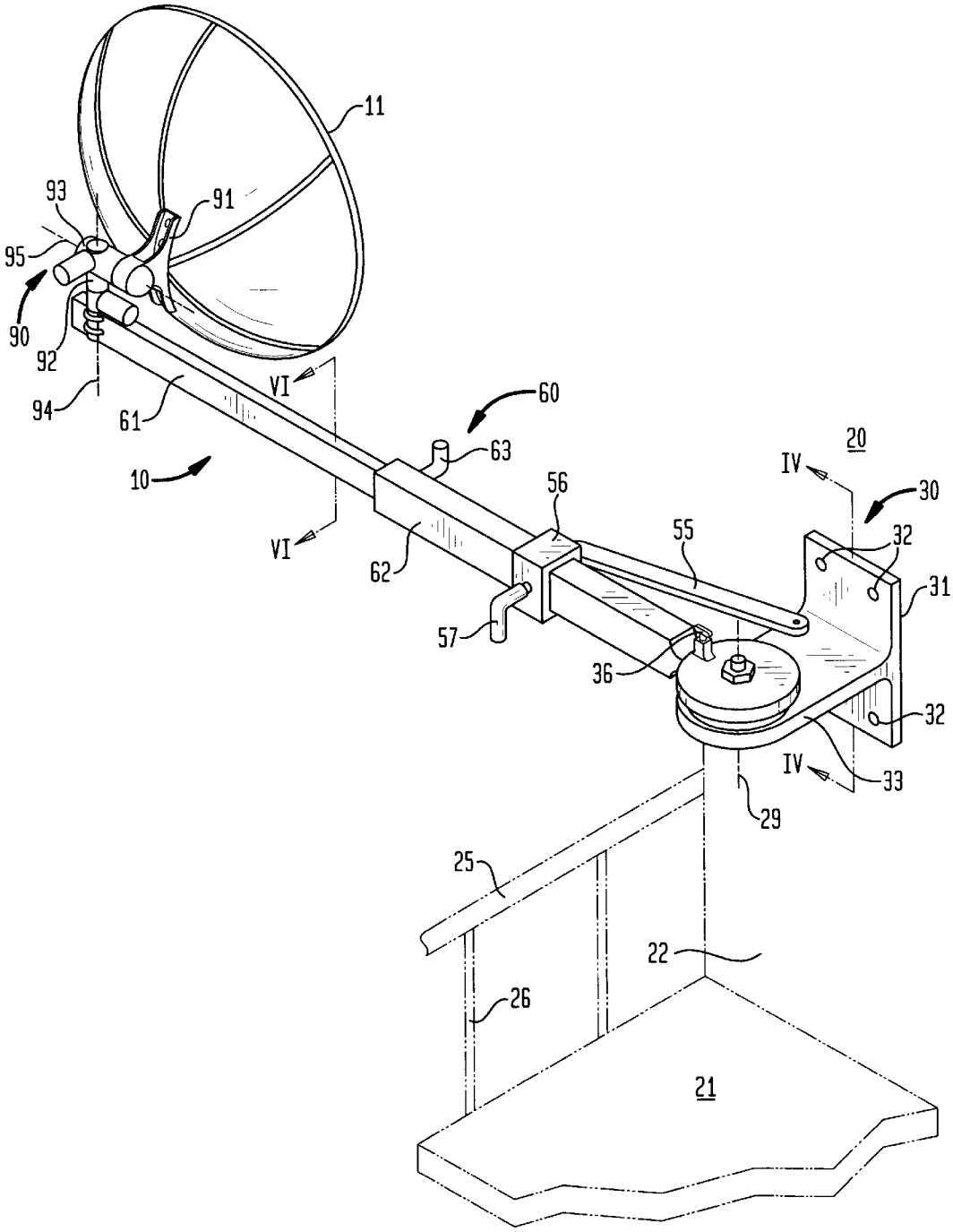
FIG. 1 is a perspective view of a moveable satellite dish antenna mount shown mounted to a non-external surface of a dwelling in accordance with the principles of the present invention.

Referring to FIG. 1, a moveable satellite dish antenna mount, generally indicated 10, is shown supporting a satellite dish antenna 11, and is mounted to a non-exterior surface 20 of a building. The term "non-exterior surface" as used herein shall mean a surface of a building other than the root and exterior walls. Examples of non-exterior surfaces include balcony ceilings. side walls, back walls and railings, and interior room walls and ceilings. While multi-unit dwellings often have rules against the mounting of antennae on exterior surfaces of the building, the mounting of antennae is often permitted on non-exterior surfaces. The moveable satellite dish antenna mount of FIG. 1 is mounted to a balcony side wall 22.

The antenna mount 10 is generally constructed of lightweight, high strength, non-corrosive materials such as aluminum, galvanized, anodized or painted steel or reinforced plastic resin. Where certain materials are particularly suited for components of the antenna mount, those materials will be noted below.

The moveable satellite dish antenna mount 10 includes a base 30 having a mounting plate 31 with screw holes 32 for mounting to a surface such as surface 20. Using screws (not shown) in holes 32, the base can be surface-mounted to a wall, ceiling or overhang. The base also includes a pivot portion 33 protruding from the plate 31 for supporting the remaining elements of the antenna mount.

Pivotably attached to the base at a base pivot 34 for rotation about a base axis 29 is an extension arm, generally indicated in FIG. 1 as 60. The extension arm may be rectangular in cross section, as shown in FIG. 1. The arm may be constructed of tubular aluminum, thin-walled steel or another lightweight, rigid construction. Alternatively, the arm may be constructed of extruded, reinforced plastic resin such as glass-filled Nylon®. The extension member 60 includes first and second telescoping members 61, 62 slideably connected for relative linear movement therebetween. In the embodiment shown in FIG. 1, element 61 slides within element 62 and the two elements may be locked in place using locking screw 63. In a currently preferred embodiment, the extension arm 60 can extend from a retracted length of about four feet to an extended length of about seven feet.

The pivot 34 may be locked in place using support arm 55, which is pivotably attached to the base 30 and is attached to the extension arm through lockable slide 56. After positioning the extension arm 60 with respect to the base 30, locking screw 57 is tightened to form a rigid triangle between the base 30, the extension arm 60 and the support arm 55, preventing further rotation.

On the distal end of the extension arm 60 is mounted a dish aiming system, generally indicated as 90 in FIG. 1. The dish aiming system may comprise die-cast aluminum, stamped steel or reinforced plastic resin housings. The dish aiming system includes two aiming pivots 92, 93 that rotate about aiming axes 94, 95, respectively. The aiming pivots 92, 93 are rotated to aim the satellite dish antenna 11, as described in more detail below. The aiming system may contain more or fewer aiming pivots, depending on the specific geometry required. A satellite dish mount 91 is attached to the dish aiming system 90 so that the dish mount is rotated with respect to the extension arm by rotation of the pivots 92, 93. The dish antenna 11 is mounted to the satellite dish mount 91 in a manner known in the art.

In the arrangement shown in FIG. 1, the moveable satellite dish antenna mount 10 is fixed to a side wall 22 of a balcony 21. Such a balcony arrangement is commonly found in multi-unit dwellings such as condominiums and apartment buildings. Regulations of multi-unit dwellings often forbid the mounting of antennas to exterior surfaces of the building such as roofs and outside walls, which are considered part of the common area of the building. Those same regulations, however, often permit the mounting of antennas on surfaces such as side wall 22 of the balcony 21. The extension member 60 permits such mounting on non-exterior surfaces while placing the satellite dish antenna 11 in a position to receive line-of-sight reception from a satellite.

Figure 2:
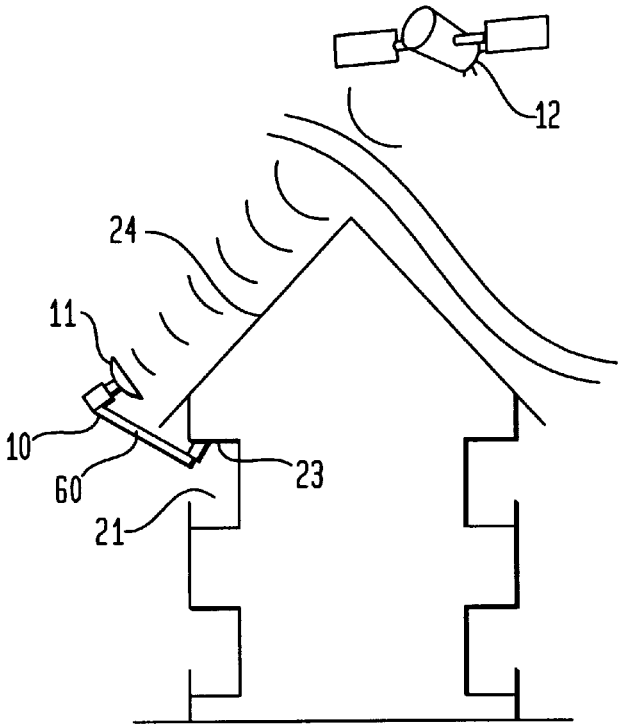
FIG. 2 is a side elevation view of a multi-unit dwelling including a moveable satellite dish antenna mount of FIG. 1 mounted thereon in accordance with the principles of one embodiment of the present invention.

In another mounting example shown in FIG. 2, the moveable satellite dish antenna mount 10 is attached to a ceiling surface 23 of the balcony 21. The extension arm 60 places the satellite dish antenna 11 beyond the roof 24, permitting line-of-sight reception from the satellite 12. It can therefore be seen that the satellite dish mount of the present invention permits a person living in a unit with exposure in a direction opposite the direction of a broadcast satellite to achieve line-of-sight reception without mounting the satellite dish antenna on the roof or other exterior surface.

Figure 3:
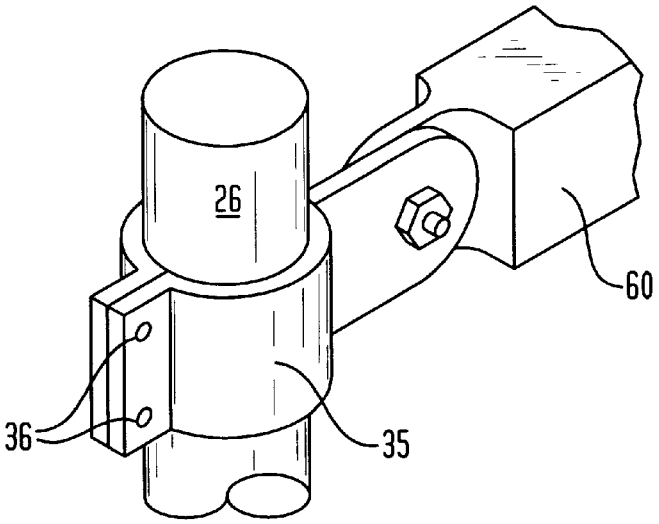
FIG. 3 is a perspective view of a railing mount of the moveable satellite dish antenna mount of FIG. 1, provided in accordance with the principles of another embodiment of the present invention.

In yet another mounting arrangement, the moveable satellite dish antenna mount 10 may be attached directly to a balcony railing baluster 26 (FIG. 3) using a railing clamp 35, which may be constructed of sheet metal. The clamp is fixed to the baluster by tightening screws 36. Other means for attachment of the moveable satellite dish antenna mount 10 to a non-exterior surface of a living unit are possible without deviating from the scope and intent of the invention. For example, the base may be attached to an interior wall, with the extension arm extending through an open window or a balcony or patio door.

The moveable satellite dish antenna mount 10 of the present invention may be displaced to and from its outboard, or broadcast reception, position. For example, the satellite dish antenna may be extended for each use and retracted when not in use. Alternatively, the dish antenna may be retracted only during severe weather or only for routine maintenance or repairs. In any case, the satellite dish antenna mount is extended and retracted by telescoping of the extension member 60, and/or by rotation of the base pivot 34.

A satellite dish antenna must be accurately aligned with the broadcast satellite to operate efficiently. It is therefore desirable to have the capability of repeatably positioning the pivot 34 after each displacement of the dish antenna from and to the outboard reception position. In a preferred embodiment of the invention, the pivot 34 (FIGS. 1 & 4) includes a locking pin 36 for locking the pivot 34 in a repeatable position after rotating the arm 60 to the outboard position.

The base pivot 34 is preferably constructed from aluminum or stainless steel and comprises a first clamping plate 37 (FIG. 4) and a second clamping plate 38 located on either side of the pivot portion 33 of the base 30. The clamping plates 37, 38 include bosses 49 that fit closely in a base pivot hole 48 in the pivot portion 33 of the base. A bolt 39, washer 41 and nut 40 are used to compress and clamp the clamping plates onto the pivot portion of the base. preventing relative motion therebetween.

The second clamping plate 38 includes an arm pivot shoulder 51 for mounting a proximal end 45 of the extension arm 60 through an arm pivot hole 50. The proximal end 45 of the arm is retained on the shoulder 51 using locking nuts 42, permitting the arm 60 to rotate about the shoulder 51. The locking pin 36 is retained on the proximal end 45 of the arm by a pin retaining block 46. A spring 47 biases the locking pin 36 into a locking pin hole 44 in a peripheral portion 43 of the second clamping member 38.

Figure 4:
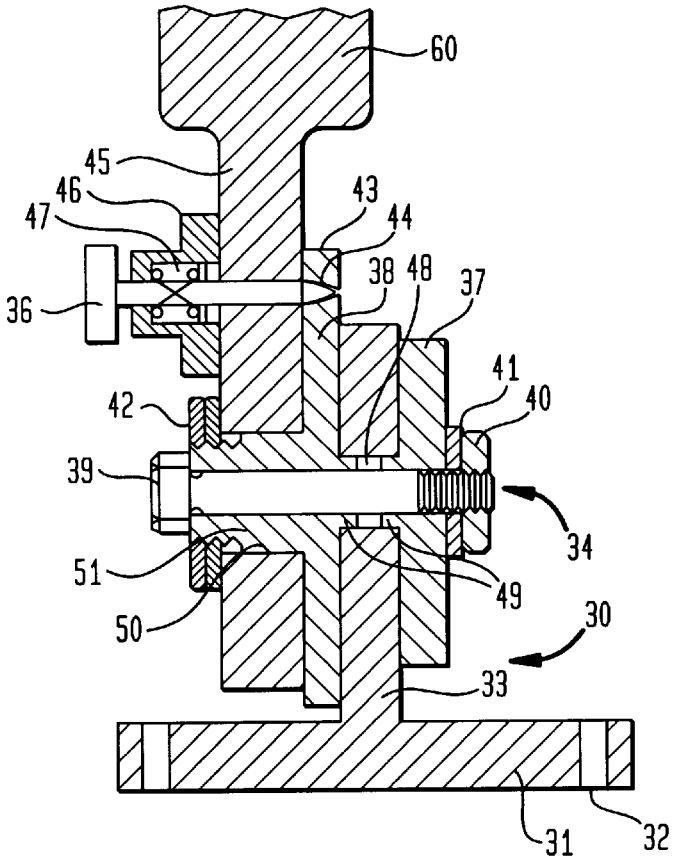
FIG. 4 is a sectional view of a locking pivot, taken along line IV—IV of FIG. 1, in accordance with the principles of another embodiment of the present invention.

To use the pivot 34 of FIGS. 1 & 4, the locking pin 36 is extended into the locking pin hole 44 and the nut 40 is loosened on the bolt 39, permitting the second locking member to rotate with respect to the base 30. The arm is extended to the outboard position so that the satellite dish antenna may be aligned with a satellite. The nut 40 is then tightened to fix the clamping members 37, 38 to the base 30. The arm may later be rotated to an inboard position by removing the locking pin from the locking pin hole and rotating the arm 60 with respect to the clamping members 37, 38, which are now fixed to the base. The arm may be returned to substantially the same outboard position by rotating the arm outward and permitting the locking pin to drop into the locking pin hole.

Figure 5:
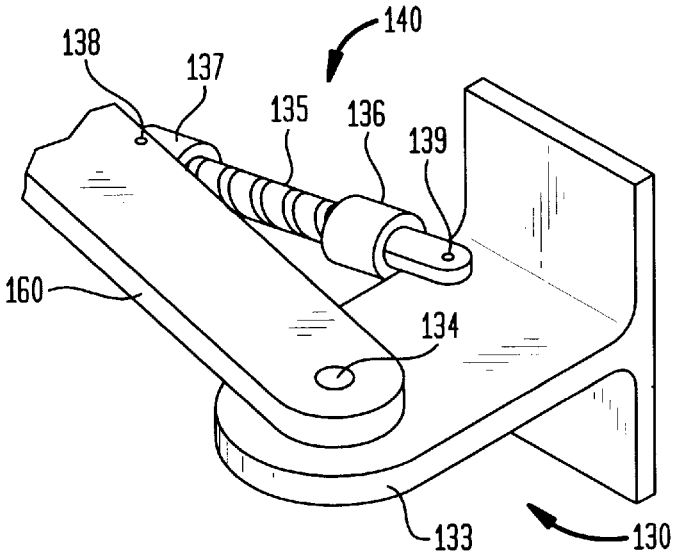
FIG. 5 is a perspective view of a motor drive for rotating the extension arm with respect to the mount of the moveable satellite dish antenna mount of FIG. 1, provided in accordance with the principles of another embodiment of the present invention.

In another embodiment of the invention, the arm pivot 134 (FIG. 5) is motorized. Such an arrangement permits remote extension and retraction of the arm, and is especially advantageous where the operator is disabled or elderly, or the base of the antenna mount of in an inaccessible location. A base 130 includes a mounting plate 131 for mounting to a non-exterior surface of the building. The arm 160 is rotatably mounted to a pivot portion 133 of the base 130. A ball screw drive 140, including a ball screw 135, a motor 136 and a ball nut 137, is attached to the arm 160 at pivot 138 and to the base 131 at pivot 139. Extension and retraction of the ball screw drive 140 rotates the arm 160. The drive may be remotely operated using a wired switch or a wireless connection. Other arrangements for remotely pivoting the arm will be apparent to those skilled in the art.

The extension arm 60 (FIG. 6) includes a first extension member 61 slideably mounted to a second extension member 62 for relative linear movement, or "telescoping" movement. The extension members preferably have non-circular cross sections such as rectangular cross sections (FIG. 1) in order to prevent relative rotation. Other cross sectional shapes such as square or elliptical may also be used. A circular cross section may be used in conjunction with an anti-rotation device such as a key (not shown) to prevent relative rotation of the first and second extension members.

Figure 6:
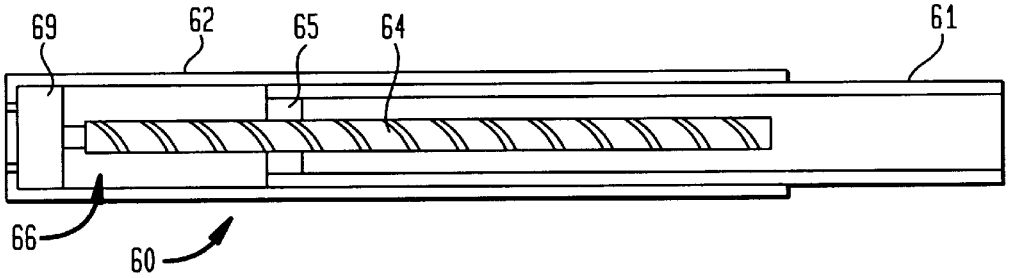
FIG. 6 is a sectional view of an extension arm of the moveable satellite dish antenna mount, taken along line VI—VI of FIG. 1, provided in accordance with the principles of one embodiment of the present invention.

In the preferred embodiment shown in FIG. 6, a ball screw assembly 66 is used to remotely operate the telescoping movement of the extension member. The ball screw assembly includes a motor 69 mounted to one of the first and second extension members, and a ball nut 65 mounted to the other of the extension members. A ball screw 64 is mounted to the motor 69. As the ball screw 64 is rotated by the motor 69, the ball nut 65 is moved relative to the ball screw, thereby telescoping the extension member. The use of a motor drive to extend the telescoping arm permits disabled and elderly persons to perform routine maintenance and cleaning of the satellite dish antenna without assistance.

The arm should be sufficiently long in its extended length to place the satellite dish antenna beyond the roof line including the eaves (see FIG. 2), or around a corner of a building. In its retracted position, the arm should be sufficiently short to swing parallel to a wall within a typical balcony of a multi-unit dwelling. In a preferred embodiment, the extension arm length is about five feet or less in an unextended condition and may be extended to about six feet or more in maximum length. In a most preferred embodiment, the extension arm is about four feet long unextended and about seven feet long fully extended.

Figure 7:
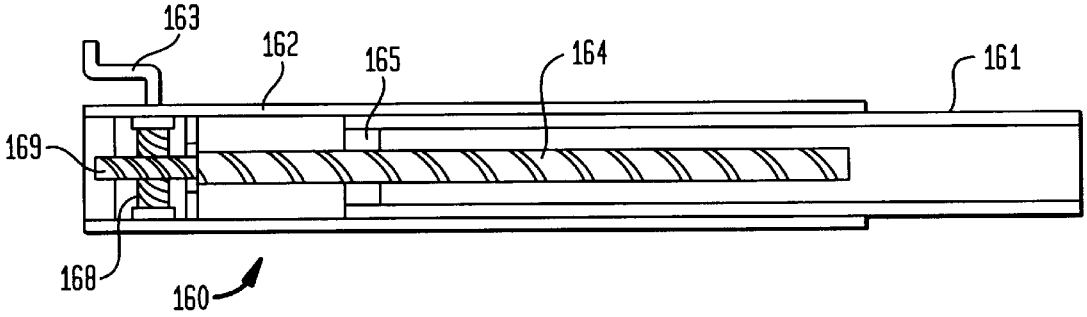
FIG. 7 is a sectional view of an alternative embodiment of the extension arm of FIG. 6.

In an alternative embodiment, an extension member 160 (FIG. 7) is extended using a hand crank 163 mounted on the proximal end of the second extension member 162. The hand crank turns worm gears 168, 169 which, in turn, rotate a screw 164. The screw displaces a nut 156 attached to the first extension member 161, causing telescoping movement between the two elements.

Figure 8:
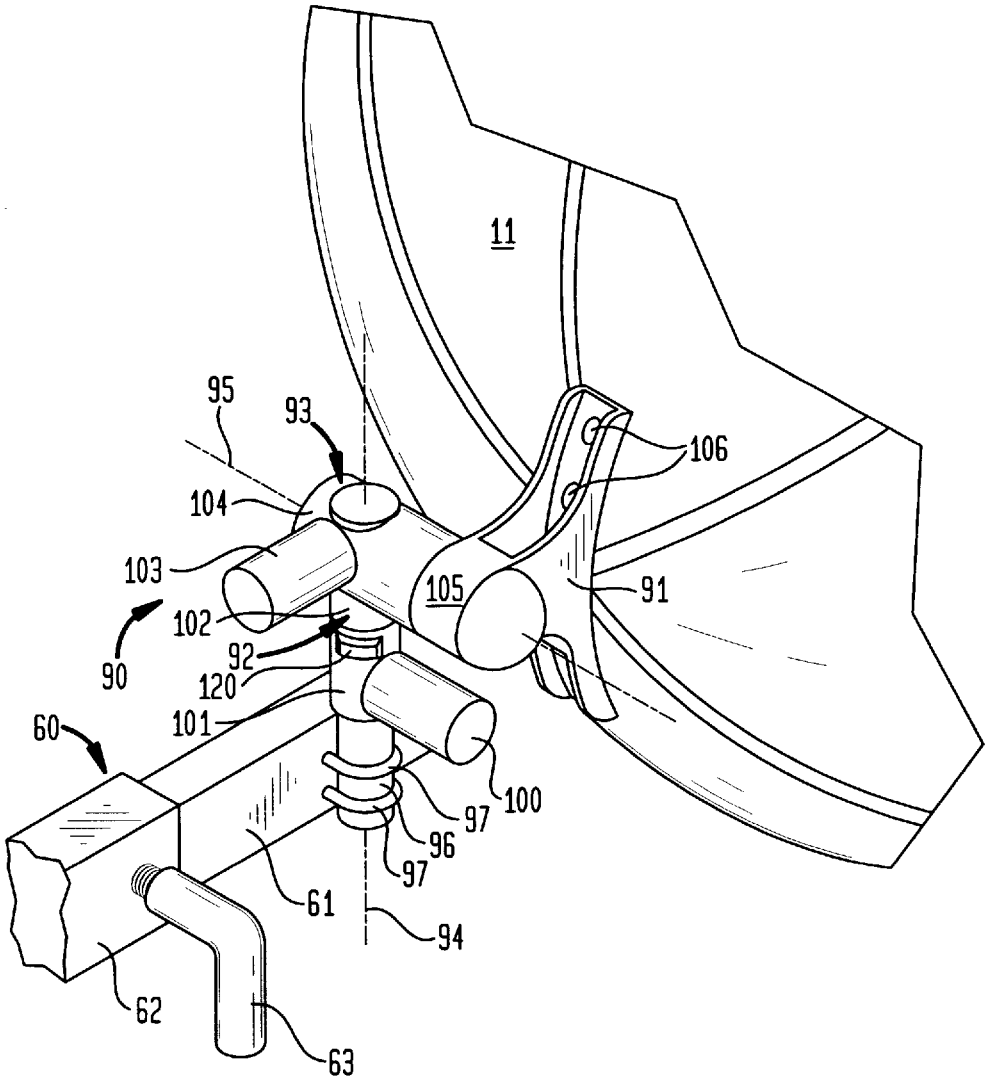
FIG. 8 is an perspective view of the antenna aiming system of the moveable satellite dish antenna mount of FIG. 1, provided in accordance with the principles of one embodiment of the present invention.

One skilled in the art will recognize that other drive mechanisms may be used to extend the extension arm. For example, the extension arm may be extended using a hydraulic or pneumatic cylinder, a rack and pinion gear mechanism or another linear actuator known in the art. Alternatively, the arm may simply consist of the two extension members to be manually extended and locked using a locking screw 63 (FIGS. 1 & 8).

The dish aiming system 90 (FIG. 8) is mounted on a distal end of the first extension member 61. The dish aiming system is remotely operable to aim the dish antenna 11 after the arm has been extended away from the building. An aiming system base 96 of the dish aiming system 90 is attached to the first extension member 61 using U-bolts 97 or other fastener means. The first aiming pivot 92 is attached to the base and includes a fixed portion 101 and a rotary portion 102. A motor 100 rotates the rotary portion 102 of the first aiming pivot 92 with respect to the fixed portion 101 about the first aiming axis 94. The motor 100 is preferably a stepping motor or alternatively another precision motor driving a rotary reduction system as is known in the art.

The second aiming pivot 93 is mounted on the rotary portion 102 of the first aiming pivot 92 for rotation therewith. The second aiming pivot includes a fixed portion 104 and a rotary portion 105. A motor 103 rotates the rotary portion with respect to the fixed portion about the second aiming axis 95. The satellite dish mount 91 is attached to the rotary portion 105 of the second pivot 93 for rotation therewith. The satellite dish antenna 11 is fixed to the dish mount 91 by bolts 106 or in another manner known in the art. A short tubular mast (not shown) may be used to support the mount.

The first and second aiming axes 94, 95 are mutually perpendicular for aiming the satellite dish in a two-dimensional polar coordinate system. Other coordinate geometries may be incorporated into the aiming system 90 to efficiently find and hold a satellite broadcast signal. Further, a dish aiming system utilizing more or fewer pivot axes, and having an alternative motor drive system or manual drive system, may be used without departing from the scope and spirit of the invention.

Figure 9:
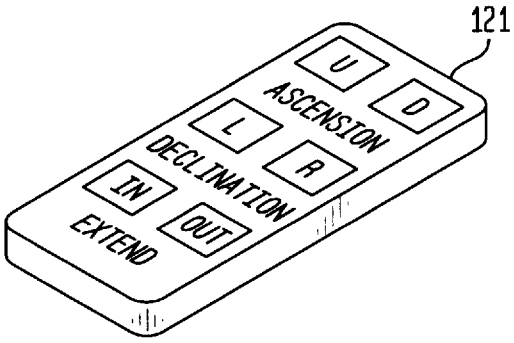
FIG. 9 is a perspective view of a remote control device provided iii accordance with the principles of one embodiment of the present invention.

The dish aiming system 90 may be controlled using buttons (not shown) hard-wired to the motors. Those buttons may be placed in a convenient location such as inside the building so that television reception may be monitored while adjusting the antenna orientation. Alternatively, the dish aiming system, as well as other motorized portions of the satellite dish antenna mount such as rotation of the base pivot 34 and telescoping of the extension arm 60, may be l0 controlled by a remote control unit 121 (FIG. 9) linked to the satellite dish antenna mount through a wireless receiver 120 (FIG. 8), which may be an infrared receiver.

In a method of placing a satellite dish 11 for reception of broadcast satellite programming according to another embodiment of the invention, the base 30 of the satellite dish mount 10 is mounted to a non-exterior surface 20 of a building, and the dish antenna 11 is mounted on the dish mount 91 of the dish aiming system 90 (FIG. 1). The extension arm 60 is rotated with respect to the base 30 about the pivot 34, moving the satellite dish antenna 11 away from the building. The extension arm 60 is also extended by telescoping the first and second telescoping members to further displace the dish antenna from the building. In this way, the antenna is positioned to have line-of-sight access to a broadcast satellite, avoiding the roof, eaves, corners or other parts of the building that might otherwise obstruct that line of sight. For example, the dish may be extended out beyond the eaves of a north-facing balcony roof to access a satellite slightly to the south. The satellite dish antenna 11 is then aimed at the satellite 12 using the dish aiming system 90.

If the antenna had been previously aligned with a satellite and the arm had been retracted for maintenance or other purposes, the base pivot 34 may be relocated in substantially the same rotary position by engaging the locking pin 36 in the locking pin hole 48. In this way, only fine tuning of the satellite dish aiming system 90 is necessary to reestablish optimum reception. Remote control of the dish aiming system facilitates this task even further.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A mount for attaching a satellite dish to a building, extending the satellite dish toward and away from the building and aligning the satellite dish to a broadcast satellite, the mount comprising:

a base for attaching the mount to the building;

an elongate extension member having first and second telescoping elements, said second telescoping element being pivotably attached to said base for rotation about a base axis, said first telescoping element being slideably mounted to said second telescoping element for relative linear movement therewith;

a dish aiming system mounted to a distal end of said first telescoping element, said aiming system comprising at least one aiming pivot for rotation about an aiming axis; and a satellite dish mount for mounting the satellite dish, said mount being attached to said dish aiming system for rotation with said at least one pivot;

whereby the satellite dish is displaced toward and away from the building by pivoting said extension member about said base axis and by sliding said second telescoping element relative to said first telescoping element, and is aligned to the broadcast satellite by rotating said satellite dish mount about said at least one aiming pivot.

2. The satellite dish mount of claim 1, wherein said base for attaching the mount to a building comprises a plate having mounting holes.

3. The satellite dish mount of claim 1, wherein said base for attaching the mount to a building is constructed and arranged for mounting to a balcony railing.

4. The satellite dish mount of claim 1, wherein said first and second telescoping elements of said elongate extension member have rectangular cross-sections.

5. The satellite dish mount of claim 1, wherein said first and second telescoping elements of said elongate extension member have round cross-sections and include an anti-rotation device for preventing relative rotation therebetween.

6. The satellite dish mount of claim 1, further comprising a motor drive for sliding said second telescoping element relative to said first telescoping element.

7. The satellite dish mount of claim 1, further comprising a handcrank-operated drive for sliding said second telescoping element relative to said first telescoping element.

8. The satellite dish mount of claim 1, further comprising a pivot lock to lock said extension member to said base to prevent pivoting.

9. The satellite dish mount of claim 8, wherein said pivot lock comprises a lockable support arm.

10. The satellite dish mount of claim 8, wherein said pivot lock includes means for locking said extension member to said base in a predetermined position.

11. The satellite dish mount of claim 10, wherein said means for locking in a predetermined position comprises a locking pin fixed to one of said extension member and said base and a locking pin hole fixed to the other of said extension member and said base.

12. The satellite dish mount of claim 1, further comprising a motor drive for pivoting said extension member with respect to said base.

13. The satellite dish mount of claim 1, wherein said extension member is extendible to a length of between about four and seven feet.

14. The satellite dish mount of claim 1, wherein said dish aiming system comprises two aiming pivots.

15. The satellite dish mount of claim 1, wherein said dish aiming system further comprises at least one motor drive for rotating said at least one aiming pivot.

16. The satellite dish mount of claim 15, wherein said at least one motor drive is remotely operable from inside the building.

17. The satellite dish mount of claim 16, wherein said motor drive includes a wireless receiver attached to said mount, and a remote control for communication with said wireless receiver from inside the building.

18. A mount for attaching a satellite dish to a building, extending the satellite dish toward and away from the building and aligning the satellite dish to a broadcast satellite, the mount comprising:

a base for attaching the mount to the building;

an elongate extension member pivotably attached to said base at a proximal end for rotation about a base axis, a pivot lock constructed and arranged to releasably lock said extension member to said base in a predetermined position to prevent pivoting;

a dish aiming system mounted to a distal end of said extension member, said aiming system comprising at least one aiming pivot for rotation about an aiming axis; and a satellite dish mount for mounting the satellite dish, said mount being attached to said dish aiming system for rotation with said at least one aiming pivot;

whereby the satellite dish is displaced toward and away from the building by pivoting said extension member about said base axis and by telescoping said extension member, and is aligned to the broadcast satellite by rotating said satellite dish mount about said at least one aiming pivot.

19. The satellite dish mount of claim 18, wherein said pivot lock comprises a locking pin fixed to one of said extension member and said base and a locking pin hole in the other of said extension member and said base.

20. A method of placing a satellite dish for reception of broadcast satellite programming, comprising the steps of: providing a satellite dish mount having a base, a telescoping extension arm pivotably attached to the base and a dish aiming system attached to the extension arm for mounting the satellite dish antenna;

mounting the base to a non-exterior surface of a building;

mounting the dish antenna on the dish aiming system rotating the extension arm with respect to the base and extending the extension arm so the satellite dish antenna has line-of-sight access to a broadcast satellite; and aiming the satellite dish antenna at the satellite using the dish aiming system.

21. The method as claimed in claim 20, wherein the dish aiming system is remotely operable and the step of aiming the satellite dish antenna is done remotely.

22. The method as claimed in claim 20, wherein the extension arm may be rotated and extended remotely and the step of extending and rotating the extension arm is done remotely.

* * * * *